US009334693B2

(12) United States Patent
Walton et al.

(10) Patent No.: US 9,334,693 B2
(45) Date of Patent: May 10, 2016

(54) VERTICAL-SCREW-AUGER CONVEYER FEEDER

(71) Applicants: Otis Walton, Livermore, CA (US); Hubert J. Vollmer, Tracy, CA (US)

(72) Inventors: Otis Walton, Livermore, CA (US); Hubert J. Vollmer, Tracy, CA (US)

( * ) Notice: Subject to any disclaimer, the term of this patent is extended or adjusted under 35 U.S.C. 154(b) by 0 days.

(21) Appl. No.: 14/847,765

(22) Filed: Sep. 8, 2015

(65) Prior Publication Data

US 2015/0376953 A1 Dec. 31, 2015

(51) Int. Cl.

| | |
|---|---|
| ***E21B 49/02*** | (2006.01) |
| ***E21B 10/43*** | (2006.01) |
| ***E21B 10/00*** | (2006.01) |
| ***E21B 10/54*** | (2006.01) |
| ***E21B 7/06*** | (2006.01) |
| ***E21B 3/00*** | (2006.01) |

(52) U.S. Cl.

CPC . *E21B 10/43* (2013.01); *E21B 3/00* (2013.01); *E21B 7/06* (2013.01); *E21B 10/003* (2013.01); *E21B 10/54* (2013.01); *E21B 49/02* (2013.01)

(58) Field of Classification Search

CPC ..... E21B 49/02; E21B 25/00; E02D 1/04; E02C 1/02

See application file for complete search history.

(56) References Cited

U.S. PATENT DOCUMENTS

| | | | | | |
|---|---|---|---|---|---|
| 1,386,802 | A * | 8/1921 | Rembert | E21B 49/02 175/243 |
| 3,822,600 | A * | 7/1974 | Stonner | G01N 1/08 73/864.43 |
| 4,345,484 | A * | 8/1982 | Gould | G01N 1/08 73/864.43 |

FOREIGN PATENT DOCUMENTS

| | | | | |
|---|---|---|---|---|
| DE | 9317105 U1 * | 1/1994 | | E21B 7/265 |
| GB | 969092 A * | 9/1964 | | E21B 7/006 |

* cited by examiner

*Primary Examiner* — Giovanna C Wright

(74) *Attorney, Agent, or Firm* — Richard B. Main; Main Law Cafe

(57) ABSTRACT

A conical feeder is attached to a vertically conveying screw auger. The feeder is equipped with scoops and rotated from the surface to force-feed regolith the auger. Additional scoops are possible by adding a cylindrical section above the conical funnel section. Such then allows the unit to collect material from swaths larger in diameter than the enclosing casing pipe of the screw auger. A third element includes a flexible screw auger. All three can be used in combination in microgravity and zero atmosphere environments to drill and recover a wide area of subsurface regolith and entrained volatiles through a single access point on the surface.

8 Claims, 7 Drawing Sheets

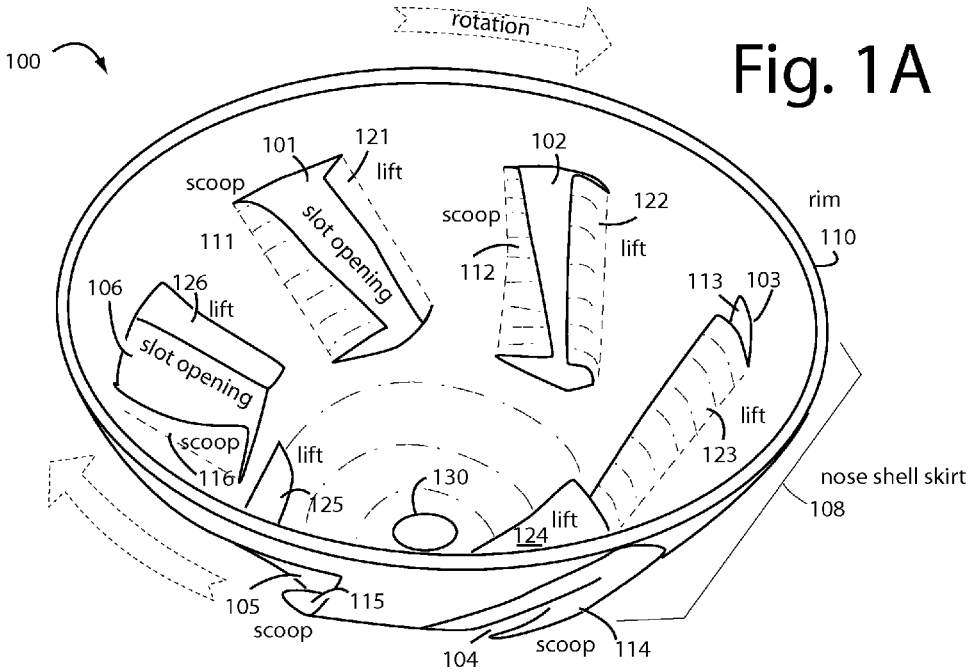
Fig. 1A
Fig. 1B
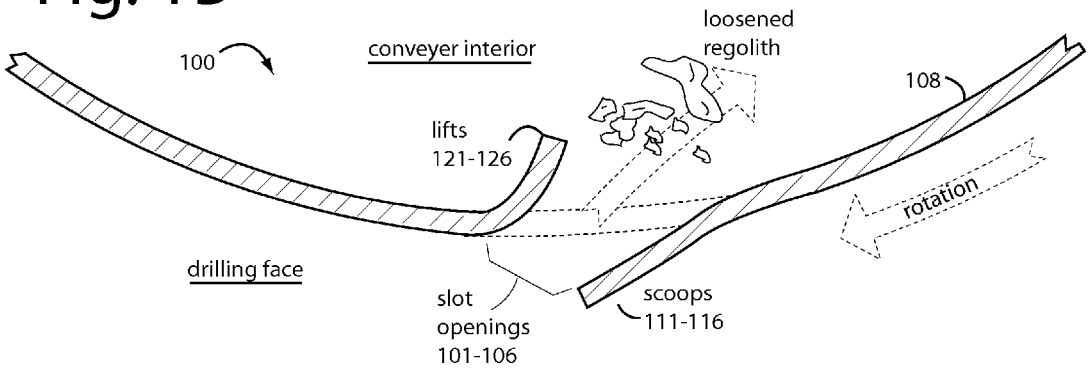

VERTICAL-SCREW-AUGER CONVEYER FEEDER

FEDERALLY SPONSORED RESEARCH/DEVELOPMENT

This invention was made with United States Government support under contracts NNX14CK06P and NNX15CK09P awarded by NASA. The Government therefore has certain rights in the invention.

BACKGROUND

1. Field of the Invention

The present invention relates to granular material feeders for screw auger conveyers, and more particularly to funnel shaped attachments to the input ends of flexible screw augers that include grater-blade slot openings or scoops outside, and blades or flow-guides inside to boost the picked-up materials to almost the rotational speed of the funnels themselves.

2. Background

Cohesive materials can sometimes be a problem to transport from a drilling site to a collecting and processing site, especially in microgravity environments. Granular solids cannot simply be pushed along inside a cylinder with a piston. So screw conveyers have been conventionally used for transporting free-flowing granular solids over modest distances.

The present inventor, Otis Walton, describes a few centrifuging conveyers for moving granular solid materials over a wide range of cohesion strengths, in U.S. Pat. No. 8,607,966, which issued Dec. 17, 2013. A screw auger is fixed to the outside surface of a fixed inner shaft. A matching, but rotating outer pipe is slipped over the outer diameter of the auger screw. The outer pipe is rotated at a high enough rate to induce granular materials introduced at an input end to cling to the outer pipe's interior walls. The auger screw will act on these clinging layers to move the granular material along to an outlet end, without clumping or clogging.

These centrifuging conveyers need feeders that can introduce granular solid materials at an input end that are boosted in speed enough to have the necessary centrifugal forces come into action. Vertical and steeply inclined orientations need specially adapted scoop-type feeders, as illustrated by FIG. 4B in U.S. Pat. No. 8,607,966. Granular solid material is scooped into conical feeder 409 externally louvered scoops 410. Axially tapered and tilted inner blades 411 ramp up and boost the introduced materials to near the speed of rotation of conical feeder 409 to start the materials moving along toward the outlet end in the layers clinging to the interior walls.

The outer pipe rotates on its axis at a rate high enough for even cohesive materials to form in layers on the interior walls. Curved auger screw blades that are either stationary or rotated at a different rate move the materials along inside. As the incoming materials are fed in, a difference in the rotational rates of the interior walls and the set angles of the several blades will dictate how fast the cohesive material is moved along the walls of the interior.

The present invention improves over conventional screw-auger conveyors with stationary outer pipes. Conventional screw-auger conveyors rotate only an inner helical screw inside of the stationary pipe. Conventional screw augers typically operate in one of two modes; in orientations where the axis is near horizontal they typically operate with slow rotation of the inner screw, and they function by material moving up the rising face of the rotating helical screw and then sliding back down its advancing face—inducing axial displacement. These slow-rotating augers will stop working if the screw-auger axis is tilted up to steep angles, or in a near-vertical orientation. Near-horizontal auger conveying, at these low rotation rates, depends on gravity to help convey dry granular solids.

Conventional screw-augers can, however, be operated in such a manner that they convey material vertically, but in this case higher rotation rates are involved and the flow modes and mechanisms that move the materials along inside up the length are significantly different from those operating in slowly rotated screw conveyors. Gravity is no longer helping and must be overcome instead.

In this vertical conveying mode the fast-rotating screws fling the material out to the outer interior walls where it can be pushed up along the wall by the helical screw auger as it rotates. The friction of the material moving in a spiral upward path along the outer wall also minimizes the amount of material that falls back down any gap that exists between the screw and wall. High rotation rates are needed to create the high centrifugal force required for this mode of near-vertical screw-conveying to function. However high rotational rates create problems at the bottom inlet feeds.

A majority of heavy industrial vertical screw conveyor are sold with attached, but separately powered, horizontal feed augers to force-feed the inlet. Other vertical conveying systems have scoops on separately rotating outer pipes to force materials into the conveying systems. Feeding vertically oriented conventional screw-auger conveyors is difficult, and few satisfactory solutions have been developed other than the separate horizontal feed augers.

Some attempts to get good enough inlet feeds for vertical screw conveyors have a retracted outer casing at the distal end that exposes several of the screw flights. This arrangement can act as a feeder. But screw extensions out beyond the end of the casing can actually fling material out and away from the screw entry. The centrifugal effects in the swirling material are responsible for feed-starving that gets worse if the rotation rates increase, or gravity is reduced.

Vertical conveying tests under lunar gravity conditions aboard NASA's reduced gravity aircraft with lunar simulants proved fast rotating screws would feed-starve and not be very effective.

There is a general need therefore for a device that can quickly feed enough material into vertical screw-auger conveying systems. And in the field of space exploration and in-situ resource utilization, there is a need for devices to extract subsurface materials through small entry holes into the surface of small airless bodies or moons, e.g., to preserve volatiles from Space. A drill-head feeder is needed for connection to flexible conveying systems when excavating materials. And one that can convey the materials to the surface through a small sealed inlet hole, and thus meet the needs of future space exploration missions.

SUMMARY OF THE INVENTION

Briefly, embodiments of the present invention include a conical feeder attached to a vertically conveying and encased screw auger. The feeder end is equipped with scoops and provides a positive-feed to the auger. Additional scoops are accommodated by adding a cylindrical section above a funnel. Such then allow the unit to collect material from swaths larger in diameter than the enclosing casing pipe of the screw auger. A third embodiment includes a flexible screw auger. All of which represent improved inlet feed units for screw auger conveyors. A tungsten carbide spade bit at the tip is further included to help drill and recover subsurface regolith and entrained volatiles over a wide area fan through a single ground-surface access hole.

These and other objects and advantages of the present invention will no doubt become obvious to those of ordinary skill in the art after having read the following detailed description of the preferred embodiments which are illustrated in the various drawing figures.

IN THE DRAWINGS

FIGS. 1A and 1B are a perspective view diagram and a lateral partial cross sectional diagram of a cutter-head nose shell embodiment of the present invention for use as a feeder vertical lift screw conveyors;

Figure 6:
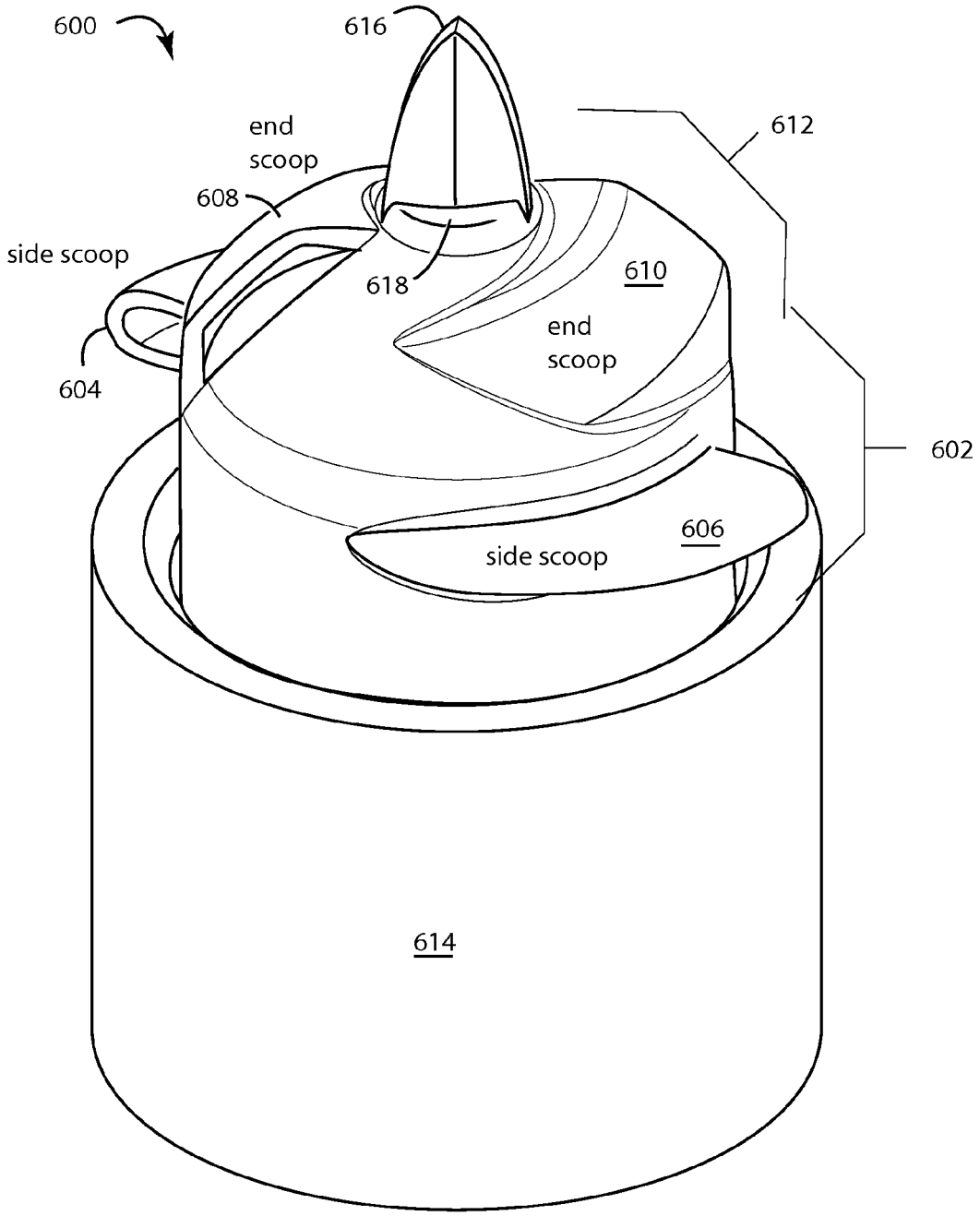
Figure 7:
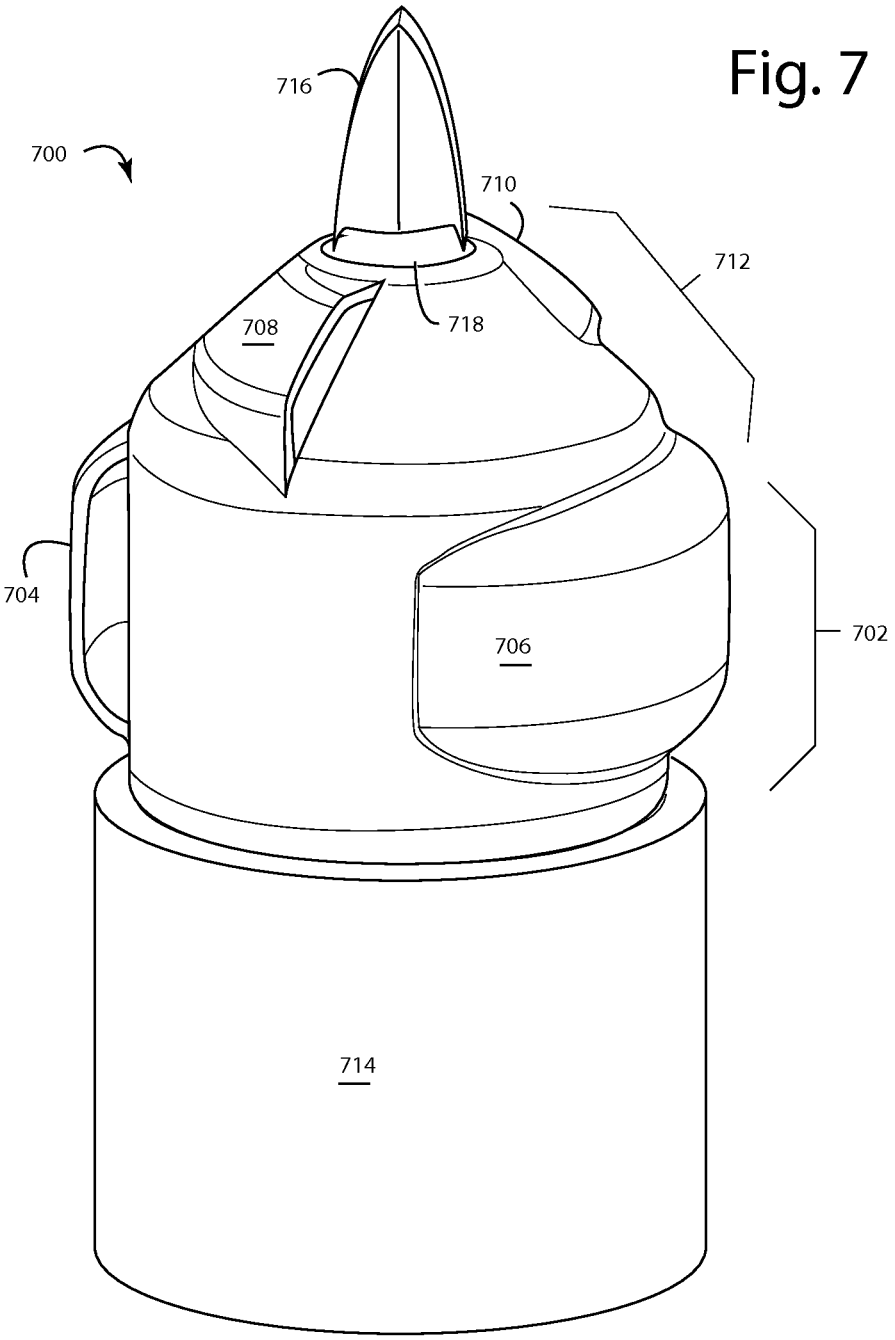

FIG. 6 is a perspective view of an alternative cutter-head with a short cylindrical extension and two side scoops set 180-degrees apart; and FIG. 7 is a perspective view of an alternative cutter-head with a long cylindrical extension and two wider side scoops also set 180-degrees apart and 90-degrees to the scoops on the conical nose section.

DETAILED DESCRIPTION OF THE PREFERRED EMBODIMENT

Regolith drill strings and equipment can be used to recover regolith and entrained volatiles in microgravity and near zero atmosphere environments. Regolith generally comprises fragments of crystalline rock, minerals, breccias, agglutinate aggregates of impact glass, other glasses, and even frozen volatiles. Collecting such volatiles without losing them to space is important. Lunar regolith is very unique from the terrestrial soils of planets like Earth, Venus, Mars, and Mercury that have water and/or atmospheres. The Moon's regolith differs in its abundance of agglutinate compared to asteroids. Many kinds of sample characterizations do not strictly require a core-sample, simple bulk-material samples of loose regolith will do nicely.

In general, micro-gravity granular solid material feeder embodiments of the present invention are funnel-shaped attachments to the input ends of vertical conveying auger screws. These include grating scoops to break compacted regolith loose from its deposits, and then force feed the loose materials inside to a screw auger conveyer. Various convex-shape nose shell configurations can work, but tapered funnel-like cones tested better than others. Hemispherical dishes would also probably work well.

More material adjacent to the nose of the auger pipe casing can be collected by adding a cylindrical extension behind the funnel section. Such has its own set of grater scoops around its middle circumference. These protrude out beyond the pipe diameter.

FIGS. 1A and 1B represent a regolith cutter-head nose shell in an embodiment of the present invention, and is referred to herein by the general reference numeral 100. The cutter-head nose shell 100 is in the general shape of a funnel or a more rounded, hemispherical bullet nose. Multiple, identical slot openings 101-106 are disposed around a conical skirt 108 and in front of a circular rim 110. Here six slot openings are shown, but more or less equally distributed can work too. Rim 110 turns with the cutter-head nose shell 100 during operation and mates with a non-turning outer conveyer pipe behind it.

In operation, the cutter-head nose shell 100 is turned by a flexible driveshaft in only one direction for digging, drilling, or feeding, as shown by the rotation arrows. Each slot opening 101-106 has an externally protruding grater scoop 111-116, and an internally curved flap or lift 121-126. All drilled and mined regolith material must pass through the slot openings 101-106 to get inside, with the oversize pieces being mechanically and automatically rejected. The loosened regolith inside is centrifugally flung by the lifts 121-126 into an auger screw conveyer attached immediately behind the cutter-head nose shell 100.

A central attachment point, here hole 130, provides for fastening to rotating driveshaft extension from a distal end of a screw auger.

Figure 2:
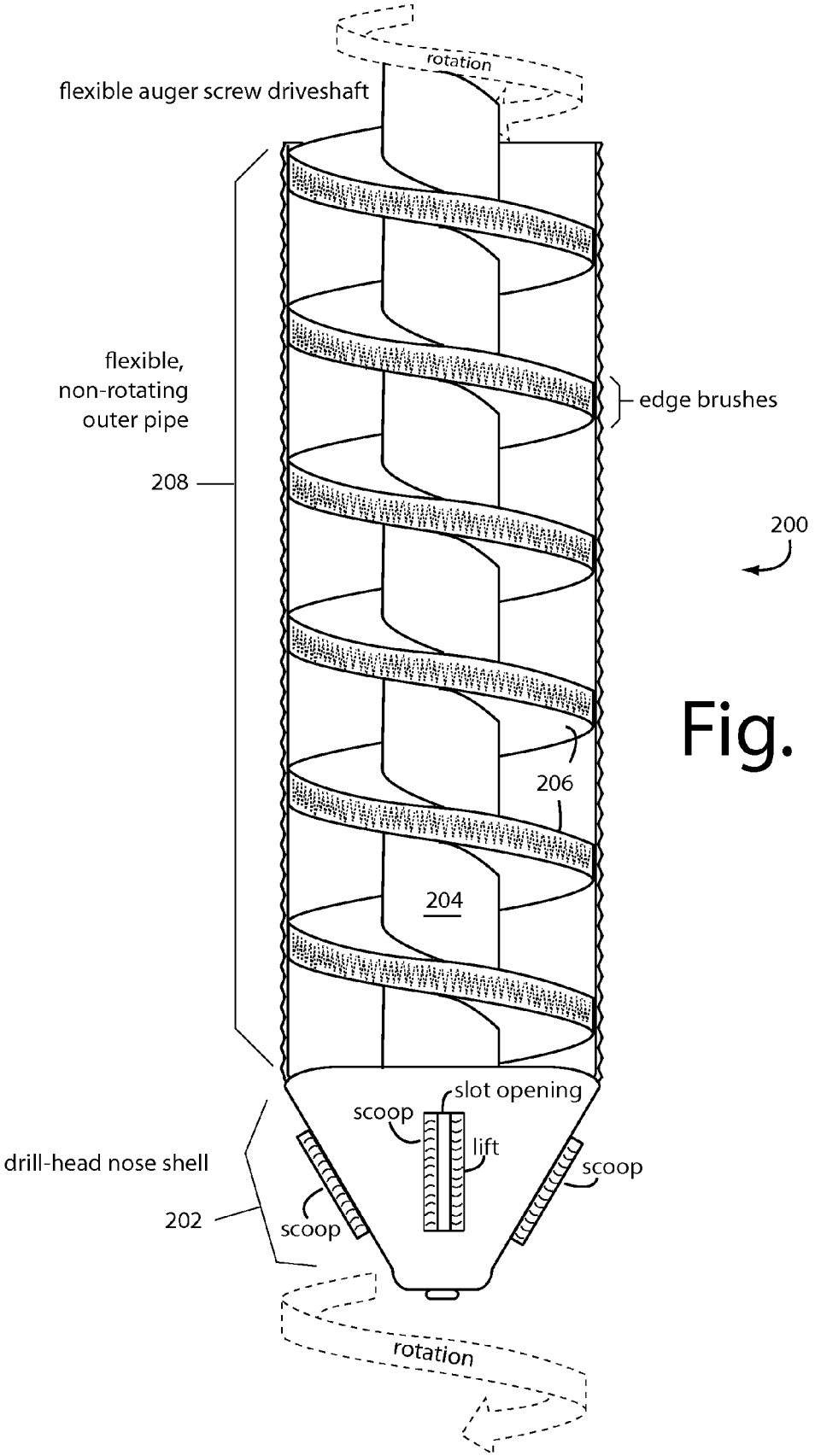
FIG. 2 is a cutaway and side view diagram of a vertical lift screw conveyor using the cutter-head nose shell feeder embodiment of FIGS. 1A and 1B.

FIG. 2 represents a regolith drillstring 200 that incorporates the cutter-head nose shell 100 of FIGS. 1A and 1B. Such is used in vertical and directional drilling. Here, a four-slot cutter-head nose shell 202 is fixed to the leading end of a flexible driveshaft 204 with an auger screw material brush helix 206. All of these turn together during drilling-down vertically inside of a non-rotating flexible outer pipe 208.

Figure 3:
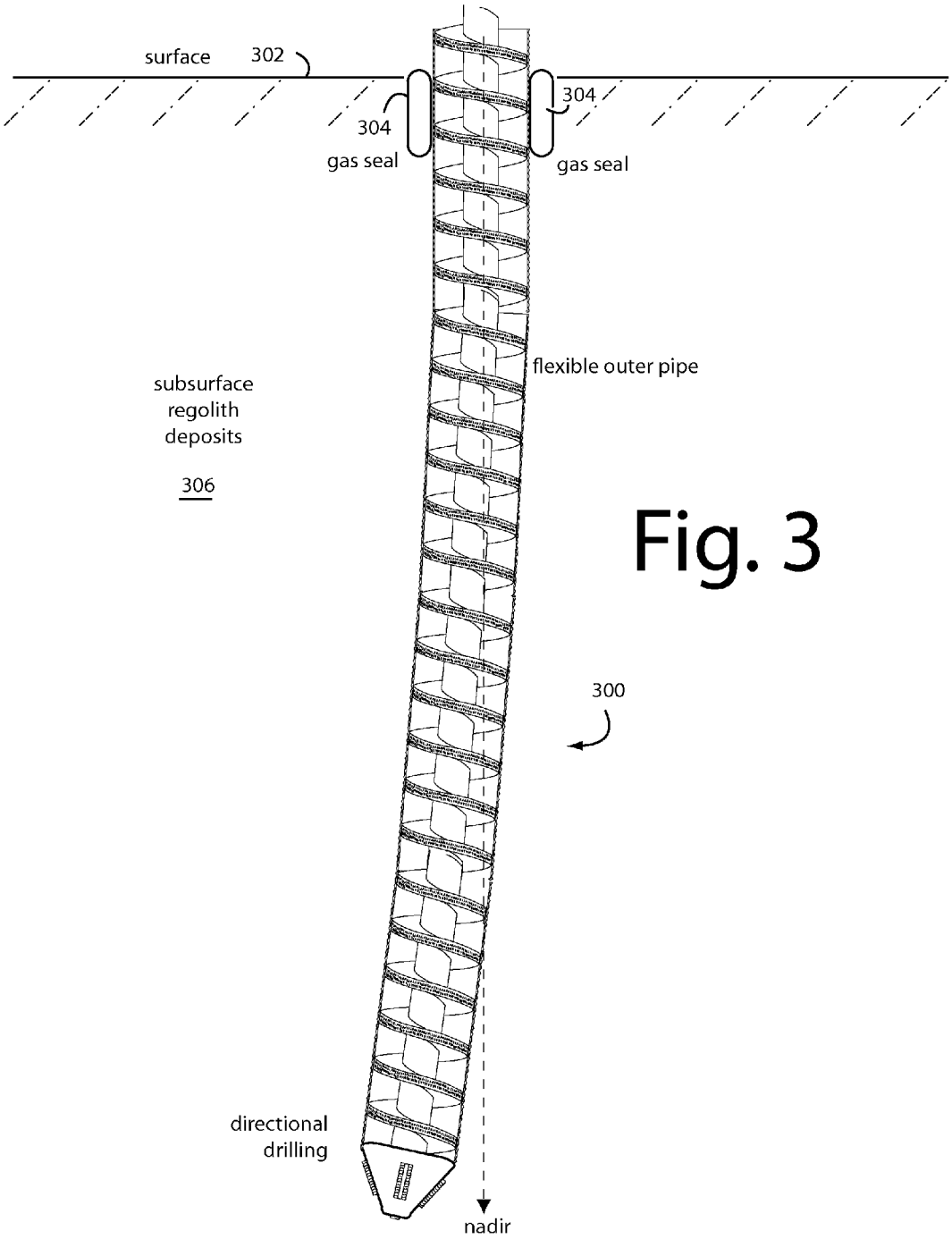
FIG. 3 is a cutaway and side view diagram of a vertical lift screw conveyor using the cutter-head nose shell feeder embodiment of FIGS. 1A and 1B as it drills into subsurface regolith deposits from the surface, and shows especially how the drillstring has enough flex to be bent for use in directional drilling.

FIG. 3 represents a more complete regolith drillstring 300 shown drilling from a surface 302 through gas seals 304 into subsurface regolith deposits 306. It is important to be able to mine a wide fan area below through a single gas-sealed access point above. The cutter-head nose shell 100 of FIGS. 1A and 1B facilitates vertical and directional drilling. The regolith drillstring 300 is shown in FIG. 3 flexed to the left during directional drilling away from nadir. Later, other directions and surrounding areas can be drilled. The gas seals 304 are needed to keep the drilling area pressurized and to prevent the escape of vaporized volatiles that may have been entrained in the loosened regolith.

Figure 4:
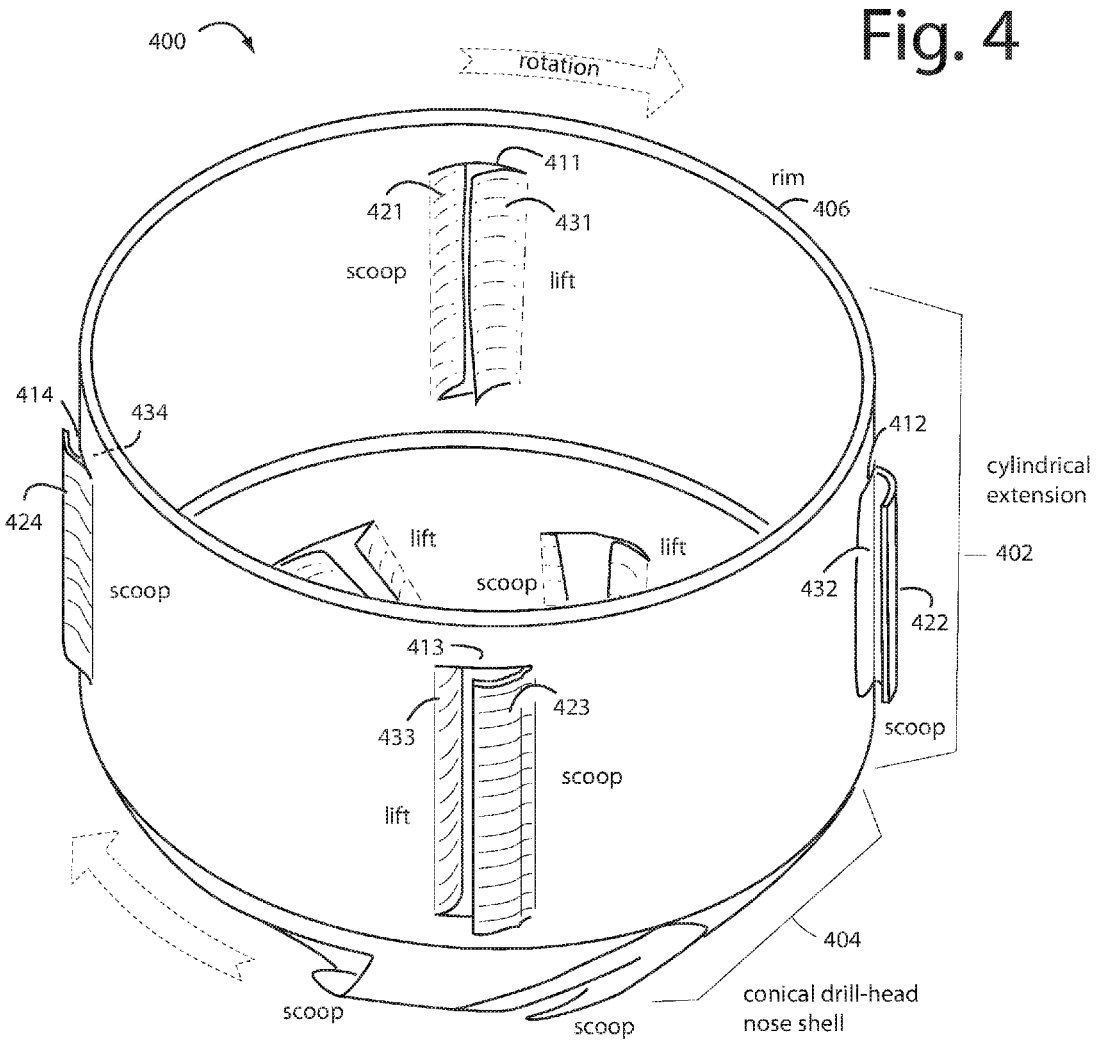
FIG. 4 is a perspective view diagram of the cutter-head nose shell embodiment of FIGS. 1A and 1B with the addition of a cylindrical extension with side acting cutter scoops that improve the ability of a drillstring like that of FIG. 3 to be turned, bent, and directed into a larger area of excavation.

The cutter-head nose shells of FIGS. 1A, 1B, 2, and 3 can all be advantageously enhanced to take a wider swath of the regolith. An extended cutter-head nose shell 400 is represented in FIG. 4 having a right cylinder section 402 fixed to the backend of a conical section 404. A circular rim 406 mates with the distal end of an outer non-rotating pipe. Here, we show four slot openings 411-414 with corresponding external grater scoops 421-424 and internally curved lifts 431-434. The conical section 404 is otherwise as shown for cutter-head nose shell 100 in FIGS. 1A and 1B. Two or more slot openings like 411-414 with corresponding external grater scoops 421-424 and internally curved lifts 431-434 can be used as long as they are equally distributed to maintain balance. There may be some advantage to tilting the four slot openings 411-414 with corresponding external grater scoops 421-424 and internally curved lifts 431-434 relative to the longitudinal axis to promote material slicing and to help advance the drillstring 400 through the regolith. Such tilting could also assist in launching materials entering the cylinder to move in the right direction.

Embodiments of the present invention include micro-gravity capable methods to dig, lift up, transport, store, and process sub-surface resource materials without losing any of their volatile constituents. Directional drilling is made possible with the flexible auger arrangement of FIG. 4. Particle-size-selective screw feeder cutter-heads use vertical auger screw conveyers to transport up loose bulk materials from the mining face in the subsurface excavations.

Regolith is highly abrasive and will wear ordinary metal tools and pipes very quickly. So the cutter-head nose shells, at least, need to be made of very hard and wear resistant materials.

A method of fabricating an oversize-rejecting cutter-head was developed. A high velocity air fuel (HVAF) metal spray in an additive manufacturing process is used to deposit Stellite-type alloy on an aluminum mandrel. Conventional machining of the aluminum mandrel could be used as the primary way to shape the cutter head. HVAF results in a very thin 0.015" (0.38 mm) nose shell with a very high Rockwell hardness and good wear resistance. A fabrication process that produced good results included:

1. Fabrication a Cutter-head master form from Aluminum Alloy 6061 T-6 using a five axis conventional profile milling;
2. Coating the Master Aluminum form with an HVAF metal spray process with Co-Base/Cr30.5/W12.5/C2.3 (which exhibits a deposited Rockwell hardness of 48-63 HRC);
3. Machining or grinding the coated form to release the cutting edges, gullet, and through-holes to accommodate end, mounting to a flexible shaft and spiral brush assembly;
4. Protecting the exterior surface of the coating with an etch resist;
5. Immersing the coated assembly in a bath of muriatic acid (HCl) 20% by volume at room temp to dissolve the aluminum mandrel.

Alternative methods to HVAF such as physical vapor deposition (PVD) etc. may also be employed to produce hard, wear resistant free standing drill head structures. Supplemental PVD processes can also be used to enhance the performance of HVAF materials.

What remains after etching is a freestanding shell of Stellite-6, 0.015" (0.381 mm) thick whose internal geometry is a high-fidelity replica of the master from. The external surface geometry is a thickened replica at lower fidelity of the master form.

In one prototype embodiment that was tested, an oversize-rejecting cutter-head was fabricated with only two inlet slot openings, each about 1.5 mm wide. Such excluded particles too large to pass through the slot openings. The volume swept out by the two inlet slot openings in one revolution of the cutter-head equaled about one quarter of the volume of one flight of the conveying screw. That meant this particular cutter-head could never over-supply material to the conveying line and would thus avoid clogging that could jam the screw.

The cutter-head tested also included a straight cylindrical section approximately one pipe-radius long. In one test, this straight section did not contribute to the conveying, nor to the feeding function. It was included as a test of the robustness of the feed from the slot openings on the tapered end, e.g., to see if enough axial thrust was produced by the centrifugal and inertial action of the cutter-head to accelerate the material so that it moves axially the distance of one radius of the conveying pipe. Once to the other side, the conveying function was taken over by the auger screw.

In experiments, this cutter-head passed its robustness test and was fed Fillite hollow silicate spheres or lunar regolith simulant JSC-1A, in a feed-controlled mode, to a nearly vertical conveying line. At 955-RPM the feed and conveying rate in a ¾" diameter screw-auger conveying line had a volume flow rate of about 200 cc/min. Such corresponds to a mass flow rate of JSC-1A of around 20 kg/hr. Extensive simulations and testing of screw conveying of sand, JSC-1A, and Fillite spheres were done using both rigid and flexible conveying lines.

Both laboratory tests and simulations were conducted of the vertical, inclined and horizontal conveying of sand and lunar simulant JSC-1A. Additional simulations extrapolated those results to lunar and micro-gravity conditions and demonstrated that screw-conveying can be both energy-efficient and robust under micro-gravity conditions.

These tests verified that a size-selective cutter-head attached to the inlet end of the screw in an auger-conveying system will deliver material to the conveying line. This is a novel feed-head for vertical screw conveyors and may have the potential to significantly improve the inlet feed efficiency of terrestrial vertical screw conveying. Preventing oversize particles from entering a screw-auger conveying line eliminates one of the major concerns often expressed about the use of screw conveyors in space applications.

The unique grater-blade-like scoops on the conical drill face described herein act to pick up regolith material and bring it inside the cutter-head. It then accelerates the loose regolith up to the rotation speed of the cutter-head. This allows the cutter-head to not run feed-starved, as is often observed in conventional vertical screw conveying.

Figure 5:
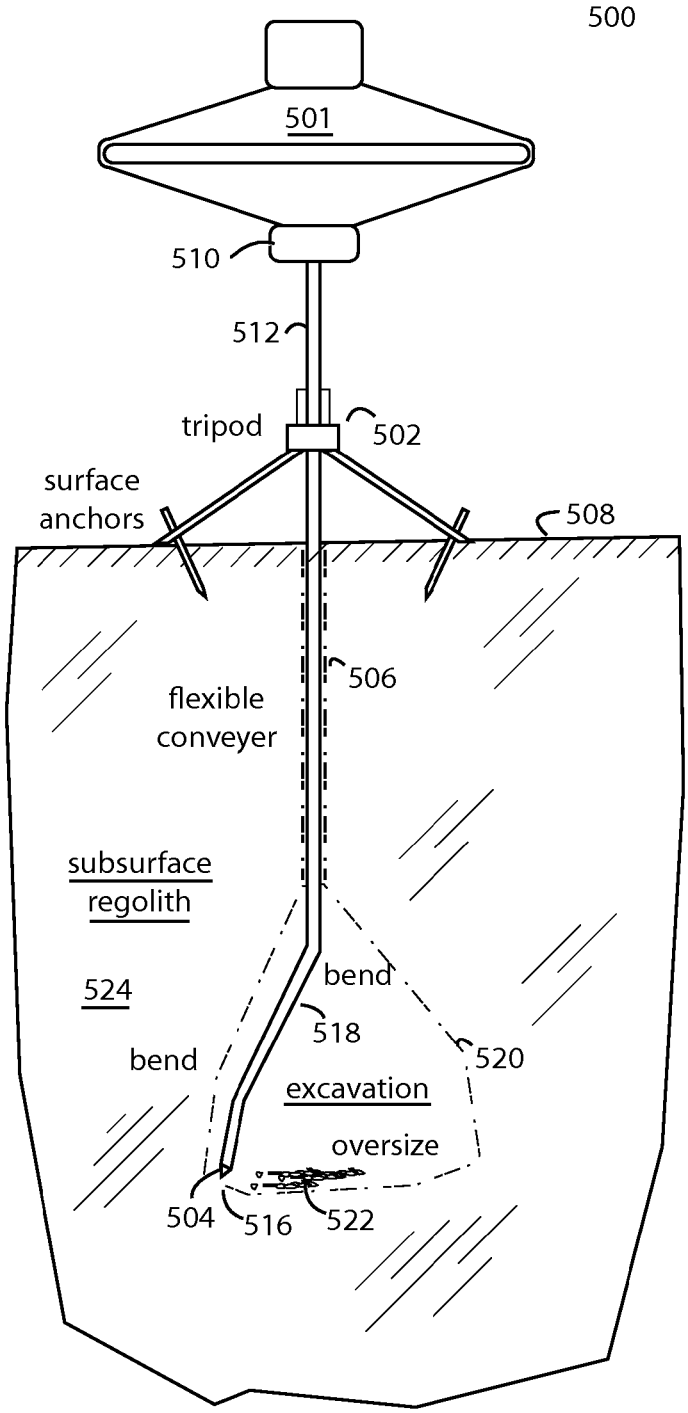
FIG. 5 is a cutaway drawing of a regolith drilling and recovery system that can be landed on an asteroid or planet, anchored to the surface, and used to drill and collect regolith and volatiles.

FIG. 5 represents a subsurface regolith extractor 500 that includes a microgravity-capable regolith storage and delivery vessel 501, an anchoring frame 502, an over-size-particle-rejecting drill bit 504, and a fully cased drill hole 506. The anchoring can include dynamic penetration probes for a primary anchor leg and simple secondary anchors, e.g., inclined screw anchors embedded into the regolith surface 508. An enclosed storage and transfer system 510 is attached to an extractor drill tube 512 does not rely on gravity to function. It instead uses centrifugal force, in flexible-auger conveying tubes and storage vessels, to move and transfer the materials.

Pneumatic conveying is not used, and no gas-solid separation operations are needed. Extractor 500 helps to minimize the loss of volatiles. Prototypes of one flexible auger conveying approach demonstrated the basic function intended.

Simulations have demonstrated that increasing the gap between a conveying screw and a conveying tube wall can improve both the robustness and efficiency of screw-conveying under micro-gravity conditions. This occurs under micro-gravity because excess material in the conveying line coats the inner walls of the conveying tube and forms a compliant layer. Such coating acts as an effective seal and produces a friction surface against which the screw can leverage to push the material along inside the line. Slow rotation rates can be used since there is no gravity to overcome, resulting in correspondingly low friction. Such conveying then becomes both reliable and relatively energy efficient, counter to our terrestrial experience and intuition.

The grater-blade-like scoops described herein on the conical drill face of the nose shell scrape-off materials on the mining face 516 and bring the loosened bits inside the cutter-head. Once inside, the loose bits are accelerated up to the rotation speed of the conveyer. This mechanism avoids feed-starving the cutter-head which was often observed in reduced gravity conditions with conventional vertical screw conveying.

The specialized flexible microgravity subsurface drilling and regolith extraction system here includes an oversize-particle-rejecting cutter-head/feeder connected to a flexible screw conveyor 518, which can be remotely controlled, to extract subsurface material from a significant volume through a single small entrance hole. This enhances a previously demonstrated size-selective cutter-head in that it can also scrape and feed material from the sides of the cutter-head into its attached flexible conveying line.

The cutting swath is a little larger than the outside diameter of the conveying line making possible the drilling around gentle bends to make horizontal extraction wells. Such can be drilled without using any drilling fluids or gases, and the whole is powered by surface-mounted rotary drive mechanisms. The mechanical nature of the drive may limit the range of the system to something less than 1000 hole diameters, or so, but for many applications this is not a significant limitation.

A two-direction lateral bend-control system allows the flexible conveying system to mimic a subsurface milling head with a built-in means of collecting the tailings and transporting them to the surface. It would be possible to excavate and extract material from a subsurface volume which is substantially larger than the size of the drill hole, assuming the surrounding material 524 is compacted and/or cohesive enough that the walls would stay intact.

An enlarged diameter extraction region 520 could be started at any predetermined depth, e.g., 1-2 meters below the surface. The size-selective cutter-head would leave oversize material 522 in the hole, and the flexible conveyor could move around obstacles that were of a size on the order of the drill-hole (or conveying line) in case a subsurface rock ended up being in the way, or the hole needed to go around some other obstacle.

An X-Y joystick manipulator control system can be added to enable the cutter-heads to be moved laterally in two dimensions orthogonal to the distal end of the drillstring. When two-dimension lateral control is combined with a single-lever axial position control, the flexible drilling system becomes able to extract material from a large subsurface volumes. A control-by-wire (or wireless) joystick system with small onboard motion-control motors to control the direction and path of the lateral and axial motions of the cutter-head would be one improvement. Predetermined nominal axial and lateral extraction-paths could be programmed into a control logic board to make such drilling operations nearly autonomous, with automatic built-in interrupts should unexpected obstacles or high-torque situations occur. The capability to extract material from a much larger diameter subsurface volume than the size of the entrance drill-hole is novel, and could provide significant benefit in extracting subsurface regolith from near earth objects (NEO's) and other small bodies.

The conveying system in general depends on continuously-flexible conveying lines. Gentle continuous bends reduce frictional rotational resistance more than do a small number of relatively large angle bends. The conveying augers can have short gaps at their bend points and still convey material through the bend. Alternatively, multiple short rigid sections with short conveying gaps at small bend points together could be combined into a substantial total angle total, and with minimal increases in the frictional resistance caused by rubbing on the outer flexible conveying pipe wall.

The local bending resistance of a central shaft can be quite low at its bend-points, so a number of small fixed bend-points would allow the system to operate with lower total internal friction caused by the flexible screw rubbing on the inside of the conveyor pipe wall.

In general, the subsurface regolith extraction systems described herein are aimed primarily at obtaining volatile-containing regolith from regions of subsurface material on small airless bodies. However, much of it could also be applied to lunar or Martian ISRU operations. The kind of materials that can be mined range from fines-containing regolith similar to that found on the moon, to blocks of frozen saturated particulate-based regolith deposits. The latter sometimes must be drilled into in order to extract them. Frozen volatiles such as water ice and $CO_2$ can be extracted without melting, as long as the temperature remains below the triple point temperature of a volatile substance, e.g., 0° C. for $H_2O$, or −56.6° C. for $CO_2$. The sublimation rate may also remain relatively low at temperatures below the triple point, depending on the vapor pressure at the prevailing temperature, the available surface area, and the partial pressure of vapor surrounding the material.

For water-ice and $CO_2$-ice this means that at typical near-surface temperatures (which are usually well below −100° C.) both substances are likely to be found as solids with relatively modest sublimation rates. If the temperatures reached during drilling and extraction remain below −100° C., then most of the volatiles in the regolith will remain as solids. These volatiles then can be extracted along with the regolith by simply collecting the particulate regolith material.

In some cases the volatile ice may be in high enough concentrations that they saturate the interstitial spaces in the bulk regolith. Making extraction more like drilling weak rock and less like scooping up sand.

It has been determined during evaluations of various processes for extracting Oxygen from lunar regolith, that oxygen production via hydrogen reduction can proceed efficiently if the fluid-bed systems performing the process only have to deal with regolith particles in certain size ranges. The size-segregating cutter-head/feeder on the extraction system developed here can select a maximum particle size cut-off, above which it would exclude particles from entering the conveying system.

Most speculation concerning the distribution of ice near the surface on the moon assumes that significant concentrations up to 5% by mass could be found in certain discrete deposits within 2-3 meters of the surface in permanently shadowed regions. The extraction systems here could be used to extract ice-laden regolith from such subsurface deposits on the moon and volatile-containing subsurface materials on Mars.

The hardness of ice increases significantly as temperatures fall lower, increasing from a Mohs hardness value of around "2" or less near freezing to as high as "6" at −70° C. The hardness of ice at very low temperatures approaches that of room-temperature feldspar or room-temperature Stellite cobalt alloys used here in the cutter-head feeders.

Cryogenic drilling tests are needed of a Tungsten-Carbide tipped Stellite cutter-head penetrating into ice blocks and frozen blocks of saturated simulant particles, at temperatures as low as −150° C. to determine whether such conditions could create an issue with extraction performance. One compensating factor that reduces our concern regarding the issue of ice-hardness is the fact that any friction produced during drilling will increase the local temperature of the ice at the drill-ice interface, which will dramatically reduce the local ice hardness. Such would probably allow a Stellite alloy cutter-head to scrape off ice-shavings which can still be conveyed as solid particulates in the screw auger.

FIG. 6 represents an alternative cutter-head 600 embodiment of the preset invention with a short cylindrical extension 602 and two side scoops 604 and 606 set 180-degrees apart.

The two narrow side scoops 604 and 606 also set 90-degrees relative to a pair of scoops 608 and 610 in a conical nose section 612. A distal end 614 of an outer flexible conveyer pipe mates with a circular aft rim of cutter-head 600. A tungsten-carbide spade twist bit 616 is located on the tip of the drill-head/feeder to help break up any hard deposits encountered, and help direct the loosened material to where the grater blade scoops can pick it up and bring it inside the drill-head. The forward-pointing spade twist bit 616 is coaxially attached to the tip, ahead of a central attachment point 618 for a rotating driveshaft extension from an auger screw.

FIG. 7 is a perspective view of an alternative cutter-head 700 embodiment of the preset invention with a long cylindrical extension 702 and two wider side scoops 704 and 706 also set 180-degrees apart and 90-degrees to a pair of scoops 708 and 710 on a conical nose section 712. A distal end 714 of an outer flexible conveyer pipe mates with a circular aft rim of cutter-head 700. Here too, a tungsten-carbide spade twist bit 716 is coaxially placed on the tip of the drill-head where it can help to loosen any hard regolith deposits or ice that may be encountered. It is just ahead of a central attachment point 718 for a rotating driveshaft extension from an auger screw inside the distal end 714 of the outer flexible conveyer.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. A granular solid material cone feeder for a centrifuging screw-auger conveyer, comprising:

a funnel-shaped cutter-head nose shell of high hardness alloy with a conical skirt and a central attachment point for a rotating driveshaft;

a first set of equally distributed louvers externally disposed in the conical skirt and that open on the outside with axial-arranged digging scoops;

a first set of adjacent louvers on the inside of the nose shell with corresponding tilted or internally curved material-acceleration and deflection blades for each;

a corresponding first set of oversize-material rejecting slots disposed between the digging scoops and the material acceleration/deflection blades; and a circular aft brim or cylindrical extension to mate with a centrifuging screw-auger conveyer and contain loose material within.

2. The feeder of claim 1, further comprising:

a cone angle to the funnel-shaped cutter-head nose shell that initiates axial movement and radial acceleration of not-oversize granular-solid-material particles that pass through the slot openings.

3. The feeder of claim 1, further comprising:

a second set of equally distributed louvers externally disposed in the walls of the cylindrical extension and that open on the outside with axial-arranged digging scoops;

a second set of adjacent louvers on the inside of the cylindrical extension with corresponding tilted or internally curved material-acceleration and deflection blades for each; and a corresponding second set of oversize-material rejecting slots disposed between the digging scoops and the material acceleration/deflection blades.

4. The feeder of claim 1, further comprising:

an attachment to a flexible conveyer having controls for directional subsurface drilling of regolith with the funnel-shaped cutter-head nose shell.

5. The feeder of claim 1, further comprising:

an attachment to a subsurface regolith extractor with an anchoring frame and a fully cased drill hole.

6. The feeder of claim 1, further comprising:

a forward-pointing spade bit coaxially attached to a tip of the rotating driveshaft and ahead of the central attachment point for said rotating driveshaft.

7. The cutter-head nose shell of claim 1, wherein:

the funnel-shaped cutter-head nose shell comprises a high velocity air fuel (HVAF) metal spray for hardness and wear resistance from an additive manufacturing process with a Stellite-type alloy deposited on a machined aluminum mandrel in a primary cutter head shape about 0.015" (0.38 mm) thick.

8. A directional drillstring for mining regolith in reduced gravity and airless environments, comprising:

a granular solid material cone feeder for a centrifuging screw-auger conveyer, including:

a funnel-shaped cutter-head nose shell of high hardness alloy with a conical skirt and a central attachment point for a rotating driveshaft;

a first set of equally distributed louvers externally disposed in the conical skirt and that open on the outside with axial-arranged digging scoops;

a first set of adjacent louvers on the inside of the nose shell with corresponding tilted or internally curved material-acceleration and deflection blades for each;

a corresponding first set of oversize-material rejecting slots disposed between the digging scoops and the material acceleration/deflection blades;

a circular aft brim or cylindrical extension to mate with a centrifuging screw-auger conveyer and contain loose material within;

a cone angle to the funnel-shaped cutter-head nose shell that initiates axial movement and radial acceleration of not-oversize granular-solid-material particles that pass through the slot openings;

a second set of equally distributed louvers externally disposed in the walls of the cylindrical extension and that open on the outside with axial-arranged digging scoops;

a second set of adjacent louvers on the inside of the cylindrical extension with corresponding tilted or internally curved material-acceleration and deflection blades for each; and a corresponding second set of oversize-material rejecting slots disposed between the digging scoops and the material acceleration/deflection blades;

an attachment to a flexible conveyer having controls for directional subsurface drilling of regolith with the funnel-shaped cutter-head nose shell;

an attachment to a subsurface regolith extractor with an anchoring frame and a fully cased drill hole;

a forward-pointing spade bit coaxially attached to a tip of the rotating driveshaft and ahead of the central attachment point for said rotating driveshaft;

a flexible vertical conveyer; and a gas seal disposed along the outside of the flexible vertical conveyer to contain volatile gases under pressure near the cutter-head nose shell.

* * * * *